US010947721B2

(12) United States Patent
Schepens

(10) Patent No.: US 10,947,721 B2
(45) Date of Patent: Mar. 16, 2021

(54) CAVITY WALL THROUGH-WALL FLASHING SUPPORT SYSTEM AND METHOD

(71) Applicant: Paul Schepens, Amherstburg (CA)

(72) Inventor: Paul Schepens, Amherstburg (CA)

( * ) Notice: Subject to any disclaimer, the term of this patent is extended or adjusted under 35 U.S.C. 154(b) by 0 days.

(21) Appl. No.: 16/595,695

(22) Filed: Oct. 8, 2019

(65) Prior Publication Data

US 2020/0109555 A1 Apr. 9, 2020

Related U.S. Application Data

(60) Provisional application No. 62/742,500, filed on Oct. 8, 2018.

(51) Int. Cl.
*E04B 1/70* (2006.01)
*E04B 1/64* (2006.01)

(52) U.S. Cl.
CPC ..... *E04B 1/7053* (2013.01); *E04B 1/644* (2013.01); *E04B 1/7046* (2013.01)

(58) Field of Classification Search
CPC ..... E04B 1/7046; E04B 1/70; E04B 1/7053; E04B 1/644; E04C 2003/023; E02D 31/02
USPC ..... 52/302.1, 302.6, 169.5
See application file for complete search history.

(56) References Cited

U.S. PATENT DOCUMENTS 1,909,657 A * 5/1933 Burgin ..... E04B 1/644 52/302.1
2,935,865 A * 5/1960 Munro ..... E04B 1/644 52/302.3
3,293,810 A * 12/1966 Cox ..... E04B 1/7046 52/302.6
3,585,766 A * 6/1971 Jamieson ..... E04D 13/155 52/60
3,886,699 A * 6/1975 Bergmann, Jr. .... E04B 1/34315 52/91.1
4,841,687 A * 6/1989 Navetta ..... E04B 1/7023 52/204.1
5,598,673 A * 2/1997 Atkins ..... E04B 1/7046 52/302.1
5,815,986 A * 10/1998 Laska ..... E04B 1/703 52/62

(Continued)

FOREIGN PATENT DOCUMENTS

AU 2006218526 B2 9/2006
CA 2683302 C 4/2010

*Primary Examiner* — Brent W Herring
(74) *Attorney, Agent, or Firm* — Kagan Binder, PLLC

(57) ABSTRACT

A through-wall flashing support system for supporting a through-wall flashing membrane installed in a cavity wall. The system includes multiple support parts, multiple spline parts and a through-wall flashing membrane. Each support part has a flange, configured to abut and be attached to an inner wall of the cavity wall, and a base, extending with a downward slope from the lower portion of the flange such that the outer portion of the base penetrates an outer wall of cavity wall. Spline parts are configured to connect adjacent support parts. The through-wall flashing membrane extends across the cavity and covers the bases of the support parts and the spline parts. Weep holes are installed to enable water to flow through the outer wall along through-wall flashing membrane. Methods for installing this system in a new cavity wall and retrofitting an existing cavity wall are also provided.

6 Claims, 5 Drawing Sheets

(56) References Cited

U.S. PATENT DOCUMENTS 6,023,892 A * 2/2000 Sourlis ..... E04B 1/644 210/170.01
6,410,118 B1 * 6/2002 Reicherts ..... B32B 13/04 428/141
6,662,504 B2 * 12/2003 Krogstad ..... E04B 1/7046 52/61
6,786,011 B2 * 9/2004 Mares ..... E04D 13/1415 52/302.6
6,912,820 B2 7/2005 Sourlis
6,964,136 B2 * 11/2005 Collins ..... E04B 1/70 52/204.2
7,543,413 B2 * 6/2009 Sourlis ..... E04B 1/7046 52/169.5
7,543,414 B2 6/2009 Sourlis
7,900,404 B2 3/2011 Koch et al.
8,046,956 B1 * 11/2011 Hohmann, Jr. ..... E04B 1/7046 52/62
8,522,508 B1 9/2013 Collins
8,661,741 B2 * 3/2014 Hohmann, Jr. ..... E02D 31/02 52/62
8,776,447 B2 7/2014 Koch et al.
9,097,006 B2 8/2015 Johnson et al.
9,797,130 B2 10/2017 Collins et al.
10,060,126 B2 8/2018 Collins
10,428,519 B2 * 10/2019 Divito ..... E04C 3/02
2002/0152693 A1 * 10/2002 Krogstad ..... E04C 3/02 52/58
2003/0177726 A1 9/2003 Gatherum et al.
2003/0230035 A1 * 12/2003 Collins ..... E04B 1/70 52/209
2005/0210787 A1 * 9/2005 Koester ..... E04B 1/7046 52/302.1
2006/0283102 A1 * 12/2006 Sourlis ..... E04B 1/7061 52/62
2011/0277393 A1 * 11/2011 Hohmann, Jr. ..... E04B 1/7046 52/62
2011/0302863 A1 * 12/2011 Sourlis ..... E02D 19/00 52/302.1
2012/0017527 A1 1/2012 Koch et al.
2017/0204602 A1 * 7/2017 Collins ..... E04B 1/7046

* cited by examiner

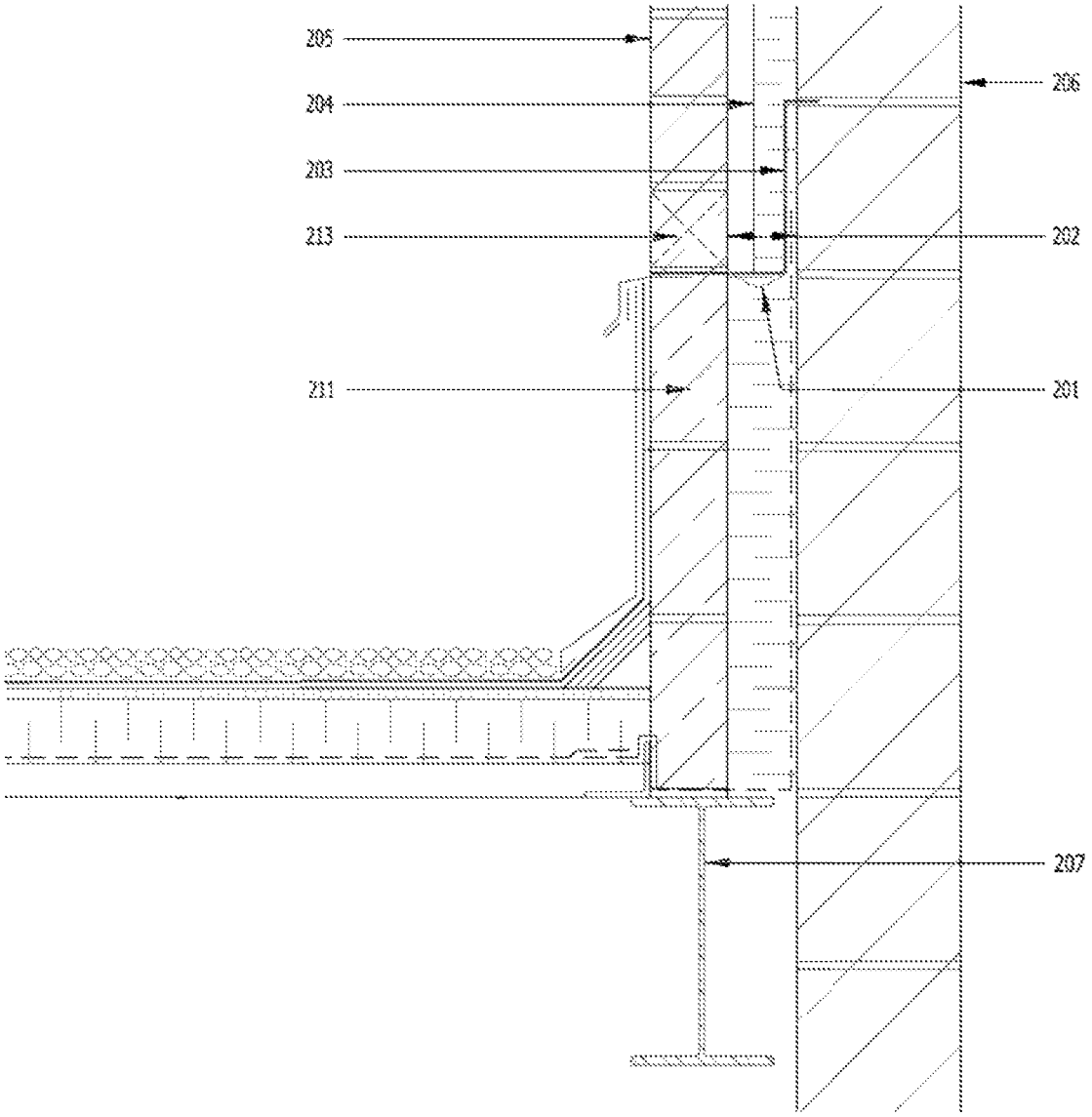
Figure 2 – Prior Art

CAVITY WALL THROUGH-WALL FLASHING SUPPORT SYSTEM AND METHOD

PRIORITY CLAIM

This application claims the benefit of U.S. Provisional Patent Application No. 62/742,500, filed Oct. 8, 2018, the content of which is incorporated herein by reference in its entirety.

BACKGROUND OF THE INVENTION

Cavity wall construction consists of two narrow upright structures (i.e. walls), usually built of stone, brick or concrete blocks, separated by a hollow space known as a cavity. The walls often enclose an area and, in this configuration, are often referred to as the inner and outer walls. The inner and outer walls have substantially the same lateral extent. The term "substantially the same", as used herein, allows for the fact that for corner sections for an outer corner the outside wall, with respect to the corner, is longer than the inside wall, and for an inner (or inside) corner the inner wall, with respect to the corner, is longer than the inside wall.

Masonry is an absorbent material, and therefore will slowly draw moisture or rainwater into the wall. The cavity has been used as a means to drain water back out through weep holes located at the base of the wall system. Over the years, the cavity has increased in size to accommodate for the additional thickness of insulation, and membranes have been added inside the cavity to help control moisture and assist with draining it back to the exterior.

A problem exists with traditional through-wall flashing systems in that water often penetrates a building by bypassing the through-wall flashing membrane installed therein. Existing flexible flashing membranes generally sag or have a "gutter effect", which holds water in the cavity between masonry wythes, a wythe being a continuous vertical section of masonry. In addition, this flexible flashing membrane has been observed to delaminate at end seams, creating an open joint to allow water to pass through and causing leaks inside the building. These leaks are not only a nuisance for property owners, property managers and occupants of the building, but could have significant financial implications. Once constructed, these details are difficult to correct without invasive measures. Leaks can cause discoloration or staining of ceiling surfaces and finishes and can lead to environmental issues, including mold in buildings.

The construction industry has attempted to develop strategies to provide support to prevent sagging or the gutter effect by using rigid insulation to fill the cavity below, but this has not shown to provide adequate support. Additionally, continuous metal has been installed to bridge the cavity but once the weight of masonry has been applied, metal can twist at adjoining seams, cutting the flexible flashing membrane. Also, providing a positive slope to the exterior has been difficult to achieve as the metal in most instances, once anchored, slopes towards the interior of the building.

SUMMARY OF THE INVENTION

A through-wall flashing support system is disclosed for supporting a through-wall flexible flashing membrane installed in a cavity wall. The cavity wall has an inner wall, having a lateral extent, and an outer wall having substantially the same lateral extent. The inner and outer walls defines a cavity between them. The flashing support system includes multiple support parts, spline parts and a through-wall flexible flashing membrane.

Each of the support parts has flange and a base and is formed from thermoplastic. The flange is configured to abut and be attached to the inner wall. The base extends laterally along the lateral extent of the flange and extends with a downward slope from the lower portion of the flange towards the outer wall. The base also has an outer portion penetrating the outer wall and is supported by the outer wall.

The support parts may include straight run parts, inner corner parts and outer corner parts. The straight run parts have a substantially straight flange and a substantially straight rectangular base. The inner corner parts and outer corner parts have a corner formed from two segments. Each segment of the corner parts is substantially perpendicular to each other, thus enabling the flanges to be attached to the inner wall at a corner.

Each of the H-channel spline parts is formed from thermoplastic and is configured to connect the bases of two adjacent thermoplastic flashing support parts. The through-wall flexible flashing membrane covers the base of each of the thermoplastic flashing support parts and extends across the cavity. The through-wall flexible flashing membrane extends through the outer wall.

The through-wall flashing support system is enabled by a plurality of weep holes extending through the outer wall. The weep holes are located immediately above a front edge of the through-wall flexible flashing membrane to define a fluid path enabling water to flow from the through-wall flexible flashing membrane covering the thermoplastic flashing support parts through the weep holes.

The through-wall flexible flashing support system may be installed in a new cavity wall, the cavity wall having an inner wall and outer wall having substantially the same lateral extent. The inner and outer wall define a cavity between them. The outer wall has a base wall and a wythe. The outer wall's wythe is supported by the base wall. The method of installation includes the steps of:

- providing multiple thermoplastic flashing support parts;
- providing multiple thermoplastic flashing H-channel spline parts;
- installing thermoplastic support parts;
- installing H-channel spline parts;
- installing a through-wall flexible flashing membrane; and
- constructing the outer wall wythe including installing the weep holes.

These steps are not necessarily all performed in the order they are listed above.

Each of the provided thermoplastic support parts has a flange and a base. The flange has a lateral extent and a lower portion. The flange is also configured to abut and be attached to the inner wall. The base extends laterally along the lateral extent of the flange, and extends with a downward slope from the lower portion of the flange. The base also has an outer portion which is configured to be supported by the base wall. Each of the provided thermoplastic flashing H-channel spline parts is configured to connect the bases of two adjacent thermoplastic flashing support parts.

The thermoplastic support parts are installed by attaching the flange of each thermoplastic support part to the inner wall, and placing an outer portion of the base of each thermoplastic support part on the base wall. Each installed thermoplastic support part is located to be adjacent to one or two other thermoplastic support parts and is located to facilitate connection of the bases of adjacent thermoplastic support parts with the thermoplastic flashing H-channel spline parts.

The H-channel spline parts are installed on the base of each thermoplastic support part by connecting each pair of adjacently installed thermoplastic support parts to each other. The through-wall flexible flashing membrane is installed such that the through-wall flexible flashing membrane covers the base of each of the thermoplastic flashing support parts and the H-channel spline parts. The weep holes are installed immediately above the through-wall flexible flashing membrane so that the weep holes define a fluid path from the cavity to the outside of the outer wall. The outer wall wythe is constructed above the through-wall flexible flashing membrane and the weep holes.

The through-wall flexible flashing support system may be installed in an existing cavity wall, the cavity wall having an inner wall and outer wall having substantially the same lateral extent. The inner and outer wall define a cavity between them. The outer wall has a base wall and a wythe. The outer wall wythe is supported by the base wall. The method of installation includes the steps of:

- providing a first and second set of thermoplastic flashing support parts;
- providing multiple thermoplastic flashing H-channel spline parts;
- removing a first set of sections from the outer wall wythe, the remaining sections of the outer wall wythe forming a first set of support sections;
- installing the first set of thermoplastic support parts;
- installing a through-wall flexible flashing membrane on the first set of thermoplastic support parts;
- constructing a second set and removing the first set of support sections including installing weep holes;
- installing the second set of thermoplastic support parts;
- installing H-channel spline parts;
- installing a through-wall flexible flashing membrane on the second set of thermoplastic support parts, the H-channel spline parts and a portion of the first set of thermoplastic support parts; and installing weep holes on the through-wall flexible flashing membrane; and
- constructing the outer wall wythe including installing the weep holes.

These steps are not necessarily all performed in the order they are listed above.

Each of the provided thermoplastic support parts has a flange and a base. The flange has a lateral extent and a lower portion. The flange is also configured to abut and be attached to the inner wall. The base extends laterally along the lateral extent of the flange, and extends with a downward slope from the lower portion of the flange. The base also has an outer portion which is configured to be supported by the base wall. Each of the provided thermoplastic flashing H-channel spline parts is configured to connect the bases of two adjacent thermoplastic flashing support parts.

The first set of removed sections are removed by cutting out segments of the outer wall wythe adjacent to the base wall. Each of the removed sections is sized to enable the installation of a thermoplastic part on the base wall. Each of the remaining segments of the outer wall wythe adjacent to the base wall form a first set of support sections.

The first set of thermoplastic support parts are installed by attaching the flange of each thermoplastic support part to the inner wall, and placing an outer portion of the base of each thermoplastic support part on the base wall. Each thermoplastic support part is installed in the first set of removed sections of the outer wall wythe.

The through-wall flexible flashing membrane is installed to substantially cover the bases of each of the first plurality of thermoplastic flashing support parts. Weep holes are installed immediately above the through-wall flexible flashing membrane so that each weep hole defines a fluid path from the cavity to outside the outer wall.

A second set of support sections is installed in the first set of removed sections of the outer wall wythe. The second set of support sections is installed on the through-wall flexible flashing membrane and the plurality of weep holes. When the second set of support sections is of a minimum strength to support the outer wall wythe without the first set of support sections, the first set of support sections may be removed. The second set of support sections is sized so that, with the first set of support sections removed to form a second set of removed sections, each removed section is sized to enable the installation of a thermoplastic part on the base wall.

The second set of thermoplastic support parts is installed by attaching the flange of each thermoplastic support part to the inner wall, and placing an outer portion of the base of each thermoplastic support part on the base wall. Each installed thermoplastic support part is located to be adjacent to one or two other thermoplastic support parts and in one of the second plurality of removed sections of the outer wall wythe. The support parts are also located to facilitate the connection of the bases of adjacent thermoplastic support parts with the thermoplastic flashing H-channel spline parts.

The H-channel spline parts are installed on the base of each thermoplastic support part by connecting each pair of adjacently installed thermoplastic support parts to each other. A second through-wall flexible flashing membrane is installed to cover the base of each thermoplastic flashing support of the second set of thermoplastic flashing support parts, the plurality of H-channel spline parts and a portion of the set of thermoplastic support parts. Weep holes are installed immediately above the through-wall flexible flashing membrane so that each weep hole defines a fluid path from the cavity to the outside of the outer wall. The outer wall wythe is constructed above the through-wall flexible flashing membrane and the weep holes.

BRIEF DESCRIPTION OF THE DRAWINGS

FIG. 18B is a perspective view of an embodiment of an inside corner part of the through-wall flashing support system.

FIG. 2 is a side sectional view of a cavity wall with an embodiment of a prior art through-wall flashing system installed.

DESCRIPTION OF THE INVENTION

The present disclosure describes a through-wall flashing support system (TWFSS) which provides support for the width of a cavity wall system to allow flexible flashing products, also known as through-wall flashings, to maximize their performance of intended use. The support system consists of thermoplastic flashing support parts (or just "parts), namely; inside (or inner) corners, outside corners, straight runs and splines. The parts can be joined together to create a continuous substratum, sloped to the exterior to allow moisture and water that penetrates the outer masonry wythe to drain at an exterior wall to roof intersection or at the base of a cavity wall system.

The use of embodiments of the TWFSS disclosed herein provide an exceptional ability to bridge the cavity along the length of the exterior wall. The parts provide full support of the through-wall flexible flashing membrane. Each part is installed onto the outer masonry support, pushed back to the inner wall and anchored to the inner wall using appropriate fasteners through the flange via integrated tie holes. The TWFSS is not intended to act as a lintel in any structural capability; it strictly provides support for the through-wall flexible flashing membrane. A positive slope is integrated into the base of each support part ensuring that water is directed outside.

Figure 1A:
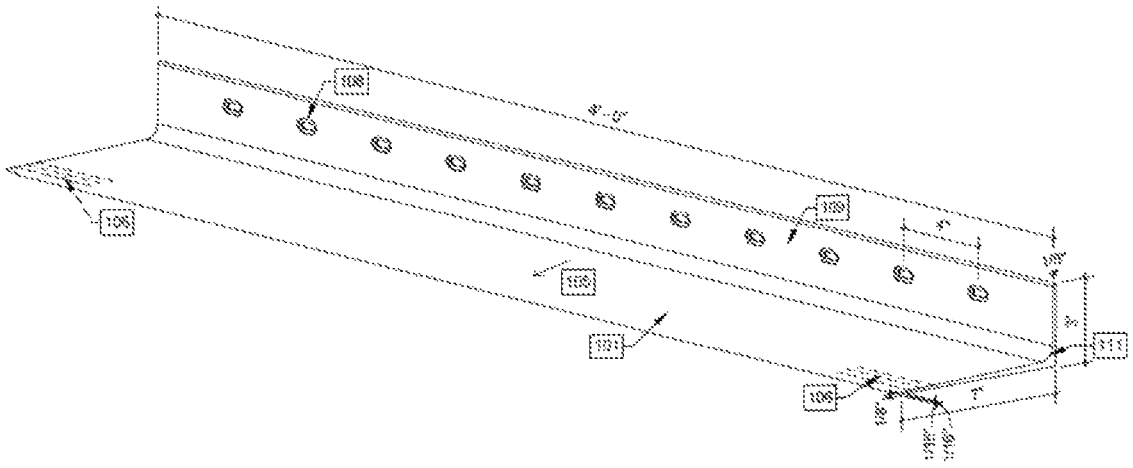
FIG. 1A is a perspective view of an embodiment of a straight run part of the through-wall flashing support system.

FIG. 1A depicts a straight run part 101 of a preferred embodiment of the TWFSS. The straight run part may be formed from a single piece of thermoplastic, the part having a surface with a base 105, a flange 109 and a curve 111. The base forms a rectangular shape with, in the depicted example part, a length of 4 feet and a width of 7 inches. The base, along the edge opposite to the curve, has a drop of $\frac{1}{8}^{th}$ of an inch. The curve opposite side of the base may also be cut along its length 106 to fit various cavity walls. The flange also forms a rectangular shape with a length of 4 feet and a width of 3 inches. The flange has tie holes 108 spaced along the length of the flange approximately every four inches. All of the dimensions stated herein are examples only.

Figure 1B:
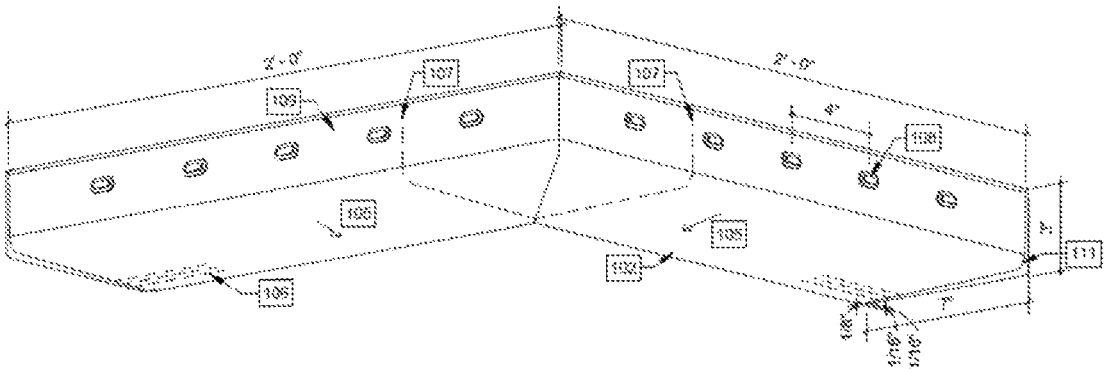
FIG. 1C is a perspective view of an embodiment of an outer corner part of the through-wall flashing support system.
FIG. 1D is a perspective view of an embodiment of a spline part of the through-wall flashing support system.

FIG. 1B depicts an inner corner part of a preferred embodiment of the TWFSS. The inner corner part 102 may be formed from a single piece of thermoplastic with two segments, each segment having a surface with a curved portion to form a base 105, a flange 109 and a curve 111. The base 105 of both the first and second segments of the part, along the edge opposite to the curve, has a drop of $\frac{1}{8}^{th}$ of an inch and may be cut along its length 106 to fit various cavity walls. The flange of both the first and second segments also form a rectangular shape with a length of 4 feet and a width of 3 inches. Each flange has tie holes 108 spaced along its length approximately every four inches.

The base 105 of both the first and second sections of the inner corner part form a trapezoidal shape with a length of approximately 2 feet along the curve adjacent side and a length of approximately 17 inches along the curve opposite side. The corners of the trapezoidal base are angled at 90, 90, 45 and 135 degrees respectively. The first section of the part is joined to the second section of the part at the base such that the 45 degree corners of the first and second sections of the part are joined and that the 135 degree corners of the first and second pieces of thermoplastic are joined. Where a support terminates at an end wall, inside corners may have a leg sawed off 107 leaving an end dam to prevent water from running off the end of the support. Similarly, on the curve opposite side of the base, the part may be cut to fit various cavity walls.

Figure 1C:
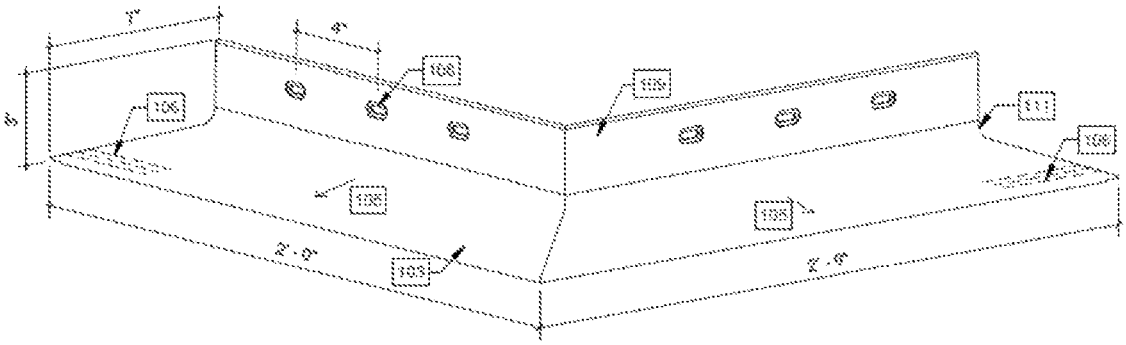

FIG. 1C depicts an outer corner part of a preferred embodiment of the TWFSS. The outer corner part 103 may be formed from a single piece of thermoplastic with two segments, each segment having a surface with a curved portion to form a base 105, a flange 109 and a curve 111. The base 105 of both the first and second segments of the part, along the edge opposite to the curve, has a drop of $\frac{1}{8}^{th}$ of an inch. The flange of both the first and second segments form a rectangular shape with a length of 4 feet and a width of 3 inches. Each flange also has tie holes 108 spaced approximately every four inches along its length.

The base of each of the first and second segments form a trapezoidal shape with a length of approximately 17 inches along the curve adjacent side of the base and a length of approximately 2 feet along the curve opposite side of the base. The corners of the trapezoidal shaped bases are angled at 90, 90, 45 and 135 degrees respectively. The first segment of the part is joined to the second segment of the part at the base such that the 45 degree corners of the first and second segments of the part are joined and that the 135 degree corners of the first and second segments are joined. Similar to the straight run and inner corner parts, the outer corner part may be cut along the curve opposite side of the base 106 to allow the part to fit various cavity walls.

Figure 1D:
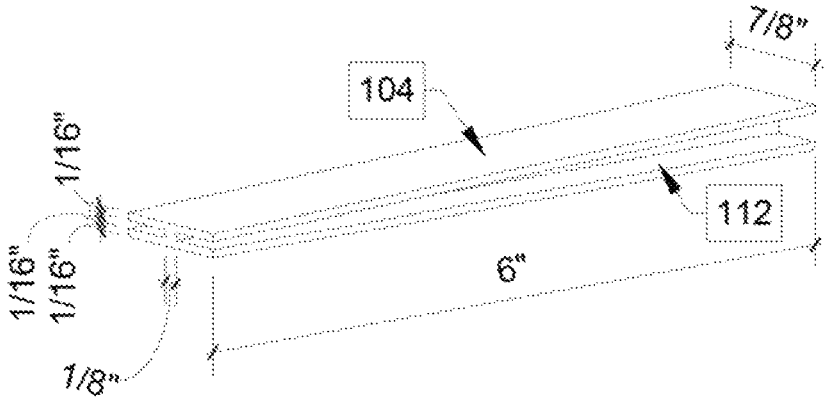

FIG. 1D depicts a spline part of a preferred embodiment of the TWFSS. The spline part is designed to allow the later ends of the bases of the straight run, inner corner and outer corner run parts to fit in the spline part. The spline part may be formed from two rectangular segments 104 attached by a connector segment 112 extending along the center of the length of a face of each of the two rectangular pieces. Each rectangular piece and the connector strip has a length of approximately 6 inches. The connector strip is ⅛ of an inch wide and its height varies from $\frac{1}{16}^{th}$ high on one side to the thickness of the base of the straight run, inner corner run or outer corner run parts 6 inches in from the lip of the base towards the curve. Each of the rectangular pieces are approximately ⅞" wide and $\frac{1}{16}^{th}$ thick.

FIG. 2 depicts a side view of a prior art through-wall flashing system installed in a building without a support system. A flexible membrane 203 is attached to the inner wall 206 and is installed through the outer wall 205. Weep holes (or brick vents) are installed and the outer wall wythe 213 is constructed, on top of the flexible membrane, along the base wall 211. The base wall may be supported by structural members 207. A weep hole, for the purposes of this disclosure, refers to any device that serves to as a way to remove moisture from the cavity and includes open head joints, wicking, tubes, corrugated channels or any other device that defines a fluid path from the cavity to outside the outer wall.

Moisture or fluid that escapes from the cavity is directed outside of the outer wall. Once the flexible membrane is installed, insulation 204 is applied to the inner wall so that moisture is directed down the inner cavity 202 to the flexible flashing membrane and the weep holes.

A through-wall flashing system without support, particularly when installed incorrectly, often suffers from membrane sagging between the point where the membrane is installed in the outer wall and the where it is attached to the inner wall. This sagging creates a gutter 201 where moisture can collect. This moisture can potentially leak past the barrier at the flashing seams or otherwise and make its way into the building.

Figure 3:
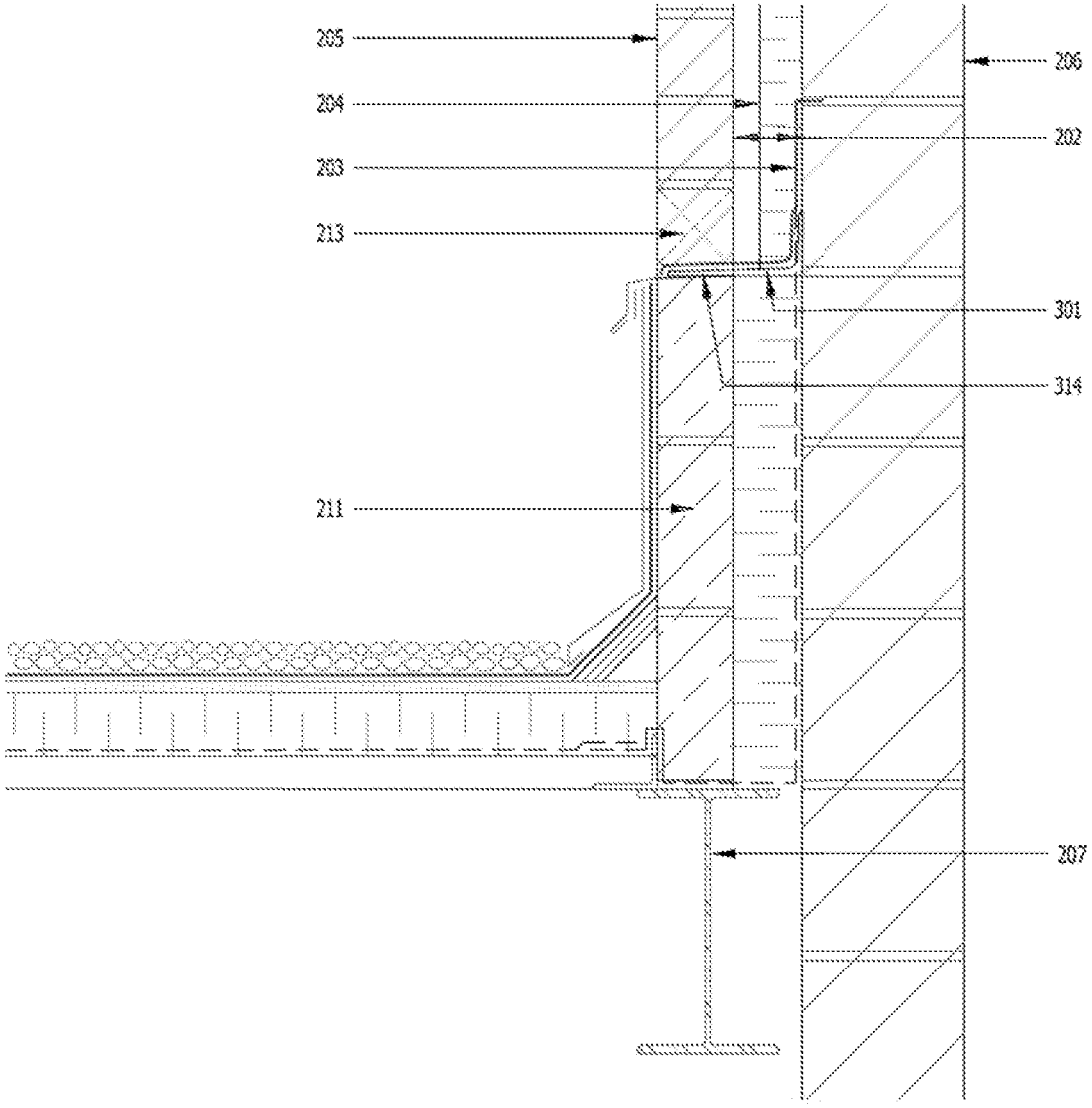
FIG. 3 is a side sectional view of a cavity wall with an embodiment of the through-wall flashing support system installed.

FIG. 3 depicts a side view of a through-wall flashing system with an embodiment of the TWFSS installed. The TWFSS system is installed along the the base wall 211. Flexible flashing membrane 203 is then attached to an inner wall 206 and is installed on top of the TWFSS 314 through the outer wall 205. Weep holes (or brick vents) are installed and the outer wall wythe 213 is constructed, on top of the flexible membrane, along the base wall. The base wall may be supported by structural members 207. Once the flexible membrane is installed, insulation 204 may be applied to the interior wall 206 so that moisture is directed down the cavity 202 to the flexible flashing membrane and the weep holes. The through-wall flashing system depicted by FIG. 3 does not suffer from membrane sagging between the point where the membrane is installed in the outer wall wythe and where it is attached to the inner wall wythe 301. The slope of the support system ensures that moisture is directed to the weep holes so that it may escape the building.

This TWFSS may be used in new construction and in the retrofit of existing through-wall flexible flashing membranes. Where a part is required to be cut to the correct length to complete the system, a jig and router is needed to route in a spline channel. In this instance, only the bottom or horizontal leg is required to be routed.

Figure 4:
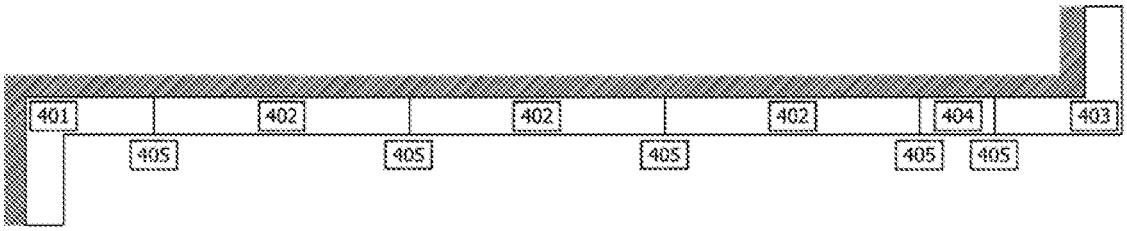
FIG. 4 is a top view of cavity wall illustrating a sequence of steps for an embodiment of the method of installing a through-wall flashing support system in a new cavity wall.

FIG. 4 depicts a plan view of a cavity wall and a preferred embodiment of a method for installing the TWFSS on said cavity wall for new construction. In the preferred embodiment depicted by FIG. 4, the method begins with the installation of a corner part. The installation steps are as follows:

1. Install an inside corner part onto a corner of the base wall and fasten the inside corner part to the inner wall 401.
2. Install a full length straight run part adjacent to the last part installed 402. Repeat this step until the most recently installed part is within 4 feet of a corner.
3. Install an outer corner part in the corner of the base wall and fasten to the inner wall 403.
4. Measure the remaining distance between the most recently installed corner and straight run parts (should be less than 4 feet), cut straight run part to suit length and fasten to inner wall 404.
5. Install spline parts between each adjacent support part 405.
6. Install a flexible flashing membrane to the specific manufacturer's specifications over length of TWFSS.
7. Repeat procedure on adjoining walls of the building until perimeter is complete.
8. Install masonry and weep holes above TWFSS once the through-wall flashing system is installed.

Figure 5:
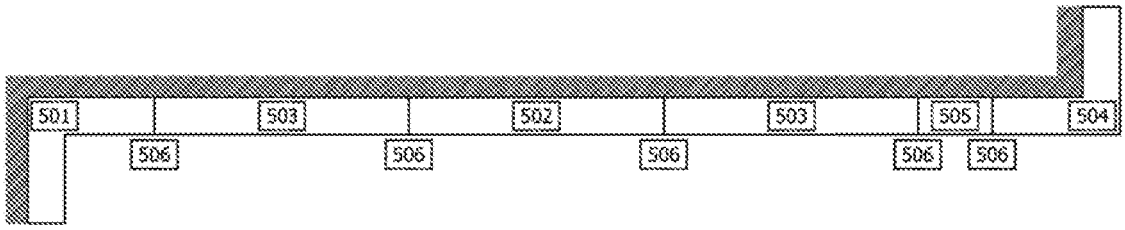
FIG. 5 is a top view of cavity wall illustrating a sequence of steps for an embodiment of the method of installing a through-wall flashing support system in a retrofit cavity wall.

FIG. 5 depicts a plan view of a cavity wall and a preferred embodiment of a method for installing the TWFSS on said cavity wall for retrofit construction. In the preferred embodiment depicted by FIG. 5, the method for installing the TWFSS with retrofit construction scenario is similar to the embodiment of the method depicted by FIG. 4 for installing the TWFSS with new construction except that the builder is now required to remove sections of the existing wythe in the outer wall order to install the TWFSS. The outer wall wythe is removed in alternating sections such that any section that is removed is flanked by two support sections supporting the remaining wythe. Once the TWFSS is installed in each of the alternating sections, the outer wall wythe is filled in and the support sections are removed. The filled in sections of the outer wall wythe become the new support sections and the former support sections become the new installation sections. Example installation steps for a preferred embodiment of the retrofit installation method are as follows:

1. Install a corner section by cutting an approximately 2 foot 4 inch wide opening and fasten the inside or outside corner part to inner wall. Next, install flashing over the corner part within 2 inches of both ends of the part 501. Install new masonry pier approximately 1 foot 8 inches wide in each direction leaving ends of flashings exposed.
2. Sawcut approximately 5 feet wide openings in the existing masonry leaving a 2 foot 8 inch wide pier in between openings alternating along the length of wall. Install a straight run part centered in each opening and fasten to the inner wall. Install a length of approximately 3 feet 8 inches of flashing centered on the TWFSS 502. Install new masonry pier approximately 4 feet 8 inches wide in line with the brick coursing head joints above on TWFSS and flexible flashing membrane.
3. Once all new masonry piers in openings have been installed and the mortar used in the masonry piers have reached a minimum strength, remove the remaining piers. Measure distance remaining between the TWFSS, cut a straight run part to suit length. Install cut straight run and fasten to the inner wall 503. Install splines between any adjacent parts 506. Install a flexible flashing membrane over the parts and overlap the flexible flashing membrane according to the manufacturer's recommendations.
4. Sawcut an approximately 2 feet 4 inch wide opening in each direction, install outside corner part and fasten to the inner wall. Install a length of approximately 22 inches of flexible flashing in each direction leaving the ends exposed and install new masonry pier approximately 16 inches wide 504.
5. Once a new masonry pier in an opening has been installed in step 4, and the mortar has achieved its minimum strength, remove existing piers remaining in location 505. Measure the distance between each installed part and cut a straight run part to suit the length. Next, install the cut straight run parts and fasten to the interior wall 505. Once all the support parts are installed, install the spline parts between each adjacent support part 506. Finally, install a flexible flashing membrane over TWFSS and overlap the membrane as per manufacturer's installation instructions.
6. Install masonry to fill in the opening and restore the outer wall.

Figure 6:
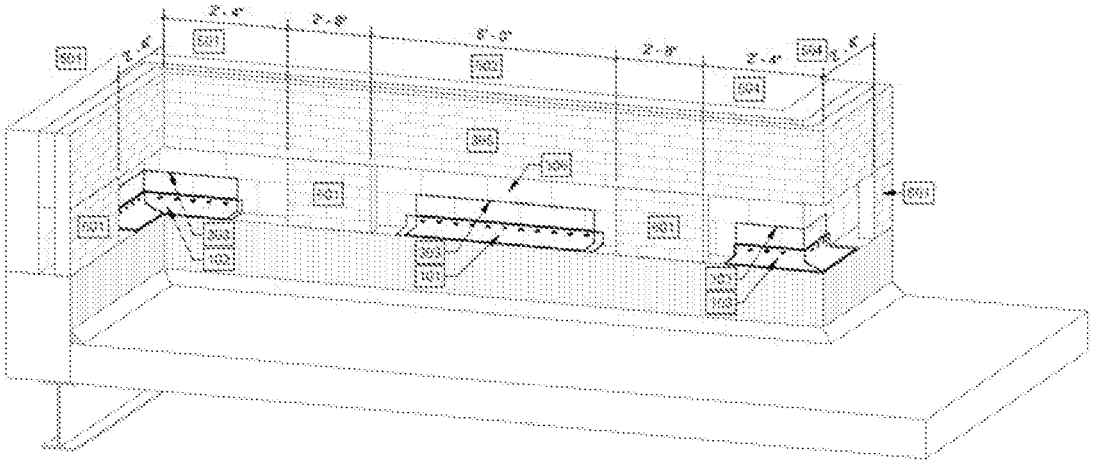
FIG. 6 is a perspective view of a cavity wall at step of the method thereof with a first plurality of thermoplastic parts installed.

FIG. 6 depicts a front perspective section view of the cavity wall with the TWFSS partially installed according to the embodiment of the retrofit installation method depicted by FIG. 5. Openings in the existing masonry have been cut to allow an inner corner part 102, a straight run part 101 and an outer corner part 103 to be installed while leaving support piers 602 along the lateral extent of the outer wall supporting the outer wall wythe 601. In the center of each of the opening, the thermoplastic support parts are fastened to the inner wall. An inner corner part, a straight run part, and an outer corner part is shown. A flexible flashing membrane is installed on each of the TWFSS support parts.

Figure 7:
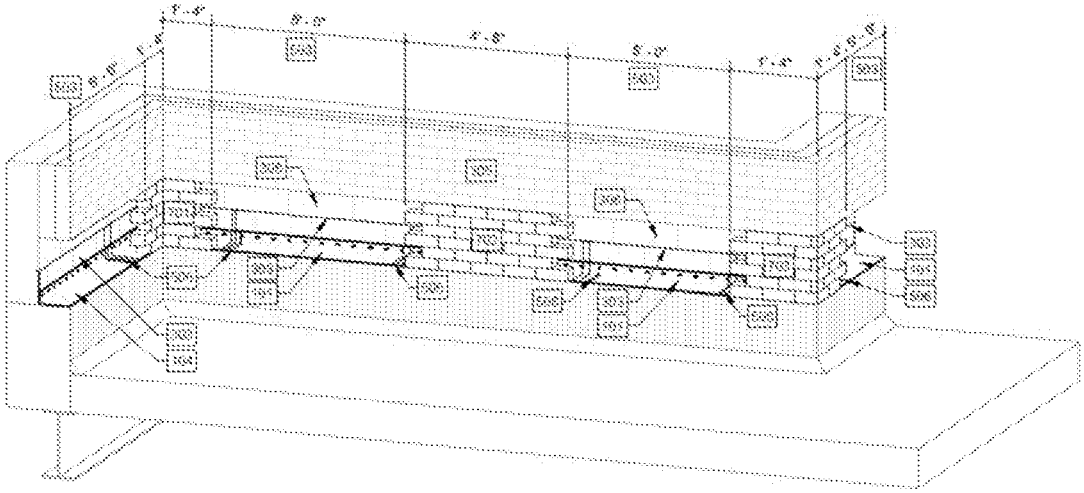
FIG. 7 is a perspective view of a cavity wall at step of the method thereof with a second plurality of thermoplastic parts installed.

FIG. 7 depicts a front perspective section view of the cavity wall with the TWFSS partially installed according to the embodiment of the retrofit installation method depicted by FIG. 5 and FIG. 6. FIG. 7 represents the installation method of FIG. 5 at later step in the installation process 503. The support piers 601 have been removed and an inner corner part, a straight run part and an outer corner part have been previously installed in the cavity wall. New support piers have been constructed on top of the base of each respective inner corner 701, straight run 702 and outer corner part 703. The new support piers are constructed out of masonry, similar to the outer wall wythe, and are of sufficient strength to support the outer wall wythe above each pier 305 and over each opening 601.

In openings where the original support piers 602 have been removed, new straight run parts 101 have been installed. These parts are placed along the base wall and attached to the inner wall 306. The straight run parts may also be cut so that they are of a suitable length to fit between previously installed parts. Each part is connected 506 to its adjacent thermoplastic support parts using the spline parts 104. A flexible flashing membrane 303 is also installed on top of the parts covering the base of each of the straight run parts, spline parts and an overlapping portion of each thermoplastic support part previously installed (i.e. the parts located behind the new support piers). The flashing is to be installed, according to the manufacturer's directions, so that it covers the entirety of the base and extends through the outer wall to provide a fluid path for any moisture in the cavity wall to the exterior. The depicted cavity wall at this step in the retrofit method has the TWFSS installed and all that remains is to install masonry to complete the opening.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed. Unless expressly stated or otherwise clearly implied herein, the conjunction "or" as used in the specification and claims shall be interpreted as a non-exclusive "or" so that "X or Y" is true when X is true, when Y is true, and when both X and Y are true, and "X or Y" is false only when both X and Y are false.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein.

The scope of the claims that follow is not limited by the embodiments set forth in the description. The claims should be given the broadest purposive construction consistent with the description and figures as a whole.

What is claimed is:

1. A through-wall flashing support system for supporting a through-wall flashing membrane installed in a cavity wall comprising an inner wall having a lateral extent and an outer wall having substantially the same lateral extent, the inner and outer walls defining a cavity therebetween, the flashing support system comprising:

a plurality of thermoplastic flashing support parts, each thermoplastic flashing support part comprising:

a flange having a lateral extent and having a lower portion, the flange being configured to abut and be attached to the inner wall; and a base integrally formed with the flange and extending laterally along the lateral extent of the flange, and extending with a downward slope from the lower portion of the flange, the base having an outer portion, wherein the base is configured so that when the thermoplastic flashing support part is installed the outer portion of the base penetrates the outer wall and the outer wall supports the base;

a plurality of thermoplastic flashing H-channel spline parts, each of the plurality of thermoplastic flashing H-channel spline parts configured to connect the bases of two adjacent thermoplastic flashing support parts, wherein each spline has a front and a rear, and has a flat upper surface and a flat lower surface and the distance between the upper and lower surfaces increases from the front to the rear;

a through-wall flexible flashing membrane having a lateral extent and having rear and front edges, the rear edge of the membrane being adhered to the flanges of the thermoplastic flashing support parts, the through-wall flashing membrane configured to extend across the cavity and covering the bases of the thermoplastic flashing support parts, wherein when the thermoplastic flashing support part is installed a portion of the through-wall flashing membrane comprising the front edge of the through-wall flashing membrane extends through the outer wall, wherein a plurality of weep holes extend through the outer wall, the weep holes being located immediately above the front edge of the through-wall flashing membrane when the membrane is installed, thereby enabling water to flow along the portion of the through-wall flashing membrane covering the bases of the thermoplastic flashing support parts and through the weep holes.

2. The through-wall flashing support system of claim 1 wherein the plurality of thermoplastic flashing support parts comprise a plurality of straight run parts, each of the plurality of straight run parts having a substantially straight flange and a substantially straight rectangular base.

3. The through-wall flashing support system of claim 1 wherein the plurality of thermoplastic flashing support parts comprise one or more than one inner corner parts, each of the inner corner parts being configured to be attached to an inner corner of the cavity wall, the flange of each of the inner corner parts comprising two segments, the segments being substantially perpendicular to each other to allow the flanges to be attached to the inner wall at an inner corner of the inner wall.

4. The through-wall flashing support system of claim 1 wherein the plurality of thermoplastic flashing support parts comprise one or more than one outer corner parts, each of the outer corner parts being configured to be attached to an outer corner of the cavity wall, the flange of each of the outer corner parts comprising two segments, the segments being substantially perpendicular to each other to allow the flanges to be attached to the inner wall at an outer corner of the inner wall.

5. The through-wall flashing support system of claim 1 wherein the plurality of thermoplastic flashing support parts comprises:

a plurality of straight run parts, each of the plurality of straight run parts having a substantially straight flange and a substantially straight rectangular base;

one or more than one inner corner parts, each of the inner corner parts being configured to be attached to an inner corner of the cavity wall, the flange of each of the inner corner parts comprising two segments, the segments being substantially perpendicular to each other to allow the flanges to be attached to the inner wall at an inner corner of the inner wall; and one or more than one outer corner parts, each of the outer corner parts being configured to be attached to an outer corner of the cavity wall, the flange of each of the outer corner parts comprising two segments, the segments being substantially perpendicular to each other to allow the flanges to be attached to the inner wall at an outer corner of the inner wall.

6. The through-wall flashing support system of claim 1 wherein the flange of each of the thermoplastic support parts comprises tie holes for attaching the flange to the inner wall using fasteners.

* * * * *